US008090577B2

(12) United States Patent
El-Maleh et al.

(10) Patent No.: US 8,090,577 B2
(45) Date of Patent: Jan. 3, 2012

(54) BANDWIDTH-ADAPTIVE QUANTIZATION

(75) Inventors: Khaled Helmi El-Maleh, San Diego, CA (US); Ananthapadmanabhan Arasanipalai Kandhadai, San Diego, CA (US); Sharath Manjunath, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 10/215,533

(22) Filed: Aug. 8, 2002

(65) Prior Publication Data

US 2004/0030548 A1 Feb. 12, 2004

(51) Int. Cl.
*G10L 19/00* (2006.01)

(52) U.S. Cl. ..... 704/230; 704/229; 704/205; 704/208; 704/221; 704/200

(58) Field of Classification Search ..... 704/230, 704/229, 200.1, 203, 222, 221, 4, 205, 208, 704/200

See application file for complete search history.

(56) References Cited

U.S. PATENT DOCUMENTS

| | | | | |
|---|---|---|---|---|
| 4,901,307 | A | 2/1990 | Gilhousen et al. | |
| 5,103,459 | A | 4/1992 | Gilhousen et al. | |
| 5,105,463 | A * | 4/1992 | Veldhuis et al. | 704/200.1 |
| 5,414,796 | A | 5/1995 | Jacobs et al. | 395/2.3 |
| 5,966,688 | A * | 10/1999 | Nandkumar et al. | 704/222 |
| 5,983,172 | A * | 11/1999 | Takashima et al. | 704/203 |
| 6,122,442 | A | 9/2000 | Purcell et al. | 395/118 |
| 6,122,608 | A | 9/2000 | McCree | 704/219 |
| 6,148,283 | A | 11/2000 | Das et al. | 704/222 |
| 6,202,045 | B1 | 3/2001 | Ojala et al. | |
| 6,233,550 | B1 | 5/2001 | Gersho et al. | |
| 6,236,961 | B1 * | 5/2001 | Ozawa | 704/221 |
| 6,330,533 | B2 * | 12/2001 | Su et al. | 704/220 |
| 6,339,757 | B1 | 1/2002 | Teh et al. | |
| 6,604,070 | B1 * | 8/2003 | Gao et al. | 704/222 |
| 7,092,881 | B1 * | 8/2006 | Aguilar et al. | 704/233 |
| 7,315,815 | B1 * | 1/2008 | Gersho et al. | 704/223 |
| 2001/0053973 | A1 | 12/2001 | Tsuzuki | 704/229 |
| 2002/0030612 | A1 * | 3/2002 | Hetherington et al. | 341/50 |

(Continued)

FOREIGN PATENT DOCUMENTS

EP 0612160 8/1994

(Continued)

OTHER PUBLICATIONS

Yeu-Shen Jehng et al: "An Efficient and Simple VLSI Tree Architect for Motion Estimation Algorithms", IEEE Transactions on Signal Processing, IEEE, Inc. New York, US, vol. 41, No. 2, Feb. 1, 1993, pp. 889-900.

(Continued)

*Primary Examiner* — Qi Han
(74) *Attorney, Agent, or Firm* — Kyong H. Macek; HeeJong Yoo

(57) ABSTRACT

Methods and apparatus are presented for determining the type of acoustic signal and the type of frequency spectrum exhibited by the acoustic signal in order to selectively delete parameter information before vector quantization. The bits that would otherwise be allocated to the deleted parameters can then be re-allocated to the quantization of the remaining parameters, which results in an improvement of the perceptual quality of the synthesized acoustic signal. Alternatively, the bits that would have been allocated to the deleted parameters are dropped, resulting in an overall bit-rate reduction.

27 Claims, 8 Drawing Sheets

U.S. PATENT DOCUMENTS

| | | | | |
|---|---|---|---|---|
| 2002/0111798 | A1 | 8/2002 | Huang | |
| 2002/0138260 | A1 * | 9/2002 | Kim et al. | 704/230 |
| 2004/0002856 | A1 * | 1/2004 | Bhaskar et al. | 704/219 |

FOREIGN PATENT DOCUMENTS

| | | | |
|---|---|---|---|
| EP | 0661826 | | 7/1995 |
| JP | 01233500 | | 9/1989 |
| JP | 6242798 | | 9/1994 |
| JP | 6511320 | | 12/1994 |
| JP | 9172413 | A | 6/1997 |
| JP | 10187197 | A | 7/1998 |
| JP | 11143499 | | 5/1999 |
| JP | 2002091497 | | 3/2002 |
| WO | WO9222891 | | 12/1992 |
| WO | WO0106490 | | 1/2001 |

OTHER PUBLICATIONS

Yoshino T. et al: "A 54MHz Motion Estimation Engine for Real-Time MPEG Video Encoding", Digest of Technical Papers of the International Conference on Consumerelectronics, ICCE, Jun. 21-23, 1994, pp. 76-77.

Jaehun Lee et al: "A New VLSI Architecture of a Hierarchical Motion Estimator for Low Bit-Rate Video Coding", ICIP 99, International Conference, Oct. 24-28, 1999, IEEE, USA, pp. 774-778.

Kuhn P. M: "Fast MPEG-4 Motion Estimation: Processor Based and Flexible VLSI Implementation", Journal of VLSI Signal Processing Systems for Signal, Image, and video Technology, Kluwer Academic Publishers, Dordrecht, NL, vol. 23, No. 1, Oct. 1999, pp. 67-92.

Caini C. et al.; "*High quality audio perceptual subband coder with backward dynamic bit allocation*" Proceedings of ICICS. International Conference of Information Communications and Signal Processing, vol. 2, pp. 762-766, Sep. 9-12, 1997.

3GPP TS 25.211, 3rd Generation Partnership Project; Technical Specification Group Radio Access Network; Physical channels and mapping of transport channels onto physical channels (FDD)(Release 5) V5.0.0 (Mar. 2002).

3GPP TS 25.212, Universal Mobile Telecommunications System (UMTS); Multiplexing and channel coding (FDD) (Release 1999) V3.10.0 (Jun. 2002).

3G TS 25.213, 3rd Generation Partnership Project; Technical Specification Group Radio Access Network; Spreading and modulation (FDD)(Release 5) V5.0.0 (Mar. 2002).

3GPP TS 25.214, 3rd Generation Partnership Project; Technical Specification Group Radio Access Network; Physical layer procedures (FDD)(Release 5) V5.0.0 (Mar. 2002).

ITU-T G.722: 7kHz Audio-Coding within 64 kbit/s (1988).

cdma2000 ITU-R Radio Transmission Technology (RTT) Candidate Submission.

TIA/EIA/IS-707-A; Data Service Options for Wideband Spread Spectrum Systems (Revision of TIA/EIA/IS-707) (Apr. 1999).

TIA/EIA/IS-95; Mobile Station-Base Station Compatibility Standard for Dual-Mode Wideband Spread Spectrum Cellular System (Jul. 1993).

TIA/EIA/IS-95-A; Mobile Station-Base Station Compatibility Standard for Dual-Mode Wideband Spread Spectrum Cellular System (May 1995).

TIA/EIA/IS-95-B; Mobile Station-Base Station Compatibility Standard for Wideband Spread Sprectrum Cellular Systems (Upgrade and Revision of TIA/EIA-95-A)(Mar. 1999).

International Preliminary Examination Report—PCT/US03025034, International Search Authority—European Patent Office—Apr. 11, 2005.

International Search Report—PCT/US03/0325034, International Search Authority—European Patent Office, Dec. 18, 2003.

* cited by examiner

NOTE: M > N

BANDWIDTH-ADAPTIVE QUANTIZATION

BACKGROUND

1. Field

The present invention relates to communication systems, and more particularly, to the transmission of wideband signals in communication systems.

2. Background

The field of wireless communications has many applications including, e.g., cordless telephones, paging, wireless local loops, personal digital assistants (PDAs), Internet telephony, and satellite communication systems. A particularly important application is cellular telephone systems for remote subscribers. As used herein, the term "cellular" system encompasses systems using either cellular or personal communications services (PCS) frequencies. Various over-the-air interfaces have been developed for such cellular telephone systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile (GSM), and Interim Standard 95 (IS-95). IS-95 and its derivatives, IS-95A, IS-95B, ANSI J-STD-008 (often referred to collectively herein as IS-95), and proposed high-data-rate systems are promulgated by the Telecommunication Industry Association (TIA) and other well known standards bodies.

Cellular telephone systems configured in accordance with the use of the IS-95 standard employ CDMA signal processing techniques to provide highly efficient and robust cellular telephone service. Exemplary cellular telephone systems configured substantially in accordance with the use of the IS-95 standard are described in U.S. Pat. Nos. 5,103,459 and 4,901,307, which are assigned to the assignee of the present invention and incorporated by reference herein. An exemplary system utilizing CDMA techniques is the cdma2000 ITU-R Radio Transmission Technology (RTT) Candidate Submission (referred to herein as cdma2000), issued by the TIA. The standard for cdma2000 is given in the draft versions of IS-2000 and has been approved by the TIA. Another CDMA standard is the W-CDMA standard, as embodied in 3rd Generation Partnership Project "3GPP", Document Nos. 3G TS 25.211, 3G TS 25.212, 3G TS 25.213, and 3G TS 25.214.

The telecommunication standards cited above are examples of only some of the various communications systems that can be implemented. Most of these systems are configured to operate in conjunction with traditional landline telephone systems. In a traditional landline telephone system, the transmission medium and terminals are bandlimited to 4000 Hz. Speech is typically transmitted in a narrow range of 300 Hz to 3400 Hz, with control and signaling overhead carried outside this range. In view of the physical constraints of landline telephone systems, signal propagation within cellular telephone systems is implemented with these same narrow frequency constraints so that calls originating from a cellular subscriber unit can be transmitted to a landline unit. However, cellular telephone systems are capable of transmitting signals with wider frequency ranges, since the physical limitations requiring a narrow frequency range are not present within the cellular system. The use of wideband signals offers acoustical qualities that are perceptually significant to the end user of a cellular telephone. Hence, interest in the transmission of wideband signals over cellular telephone systems has become more prevalent. An exemplary standard for generating signals with a wider frequency range is promulgated in document G.722 ITU-T, entitled "7 kHz Audio-Coding within 64 kBits/s," published in 1989.

The transmission of wideband signals over cellular systems entails adjustments to the system, such as improvements to the signal compression devices. Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, then the compression factor achieved by the speech coder is $C_r=N_iN_o$. The challenge is to retain high voice quality of the decoded speech while achieving the target compression factor. The performance of a speech coder depends on how well the speech model, or the combination of the analysis and synthesis process described above, performs, and how well the parameter quantization process is performed at the target bit rate of $N_o$ bits per frame. The goal of the speech model is thus to capture the essence of the speech signal, or the target voice quality, with a small set of parameters for each frame.

For wideband coders, the extra bandwidth of the signal requires higher coding bit rates than a conventional narrowband signal. Hence, new bit-rate reduction techniques are needed to reduce the coding bit rate of wideband voice signals without sacrificing the high quality associated with the increased bandwidth.

SUMMARY

Methods and apparatus are presented herein for reducing the coding rate of wideband speech and acoustic signals while preserving the perceptual quality of the signals. In one aspect, a bandwidth-adaptive vector quantizer is presented, comprising: a spectral content element for determining a signal characteristic associated with at least one analysis region of a frequency spectrum, wherein the signal characteristic indicates a perceptually insignificant signal presence or a perceptually significant signal presence; and a vector quantizer configured to use the signal characteristic associated with the at least one analysis region to selectively allocate quantization bits away from the at least one analysis region if the signal characteristic indicates a perceptually insignificant signal presence.

In another aspect, a method for reducing the bit-rate of a vocoder is presented, the method comprising: determining a frequency die-off presence in a region of a frequency spectrum; refraining from quantizing a plurality of coefficients associated with the frequency die-off region; and quantizing the remaining frequency spectrum using a predetermined codebook.

In another aspect, a method is presented for enhancing the perceptual quality of an acoustic signal passing through a vocoder, the method comprising: determining a frequency die-off presence in a region of a frequency spectrum; refraining from quantizing a plurality of coefficients associated with the frequency die-off region; reallocating a plurality of quantization bits that would otherwise be used to represent the frequency die-off region; and quantizing the remaining frequency spectrum using a super codebook, wherein the super codebook comprises the plurality of quantization bits that would otherwise be used to represent the frequency die-off region.

DETAILED DESCRIPTION

Figure 1:
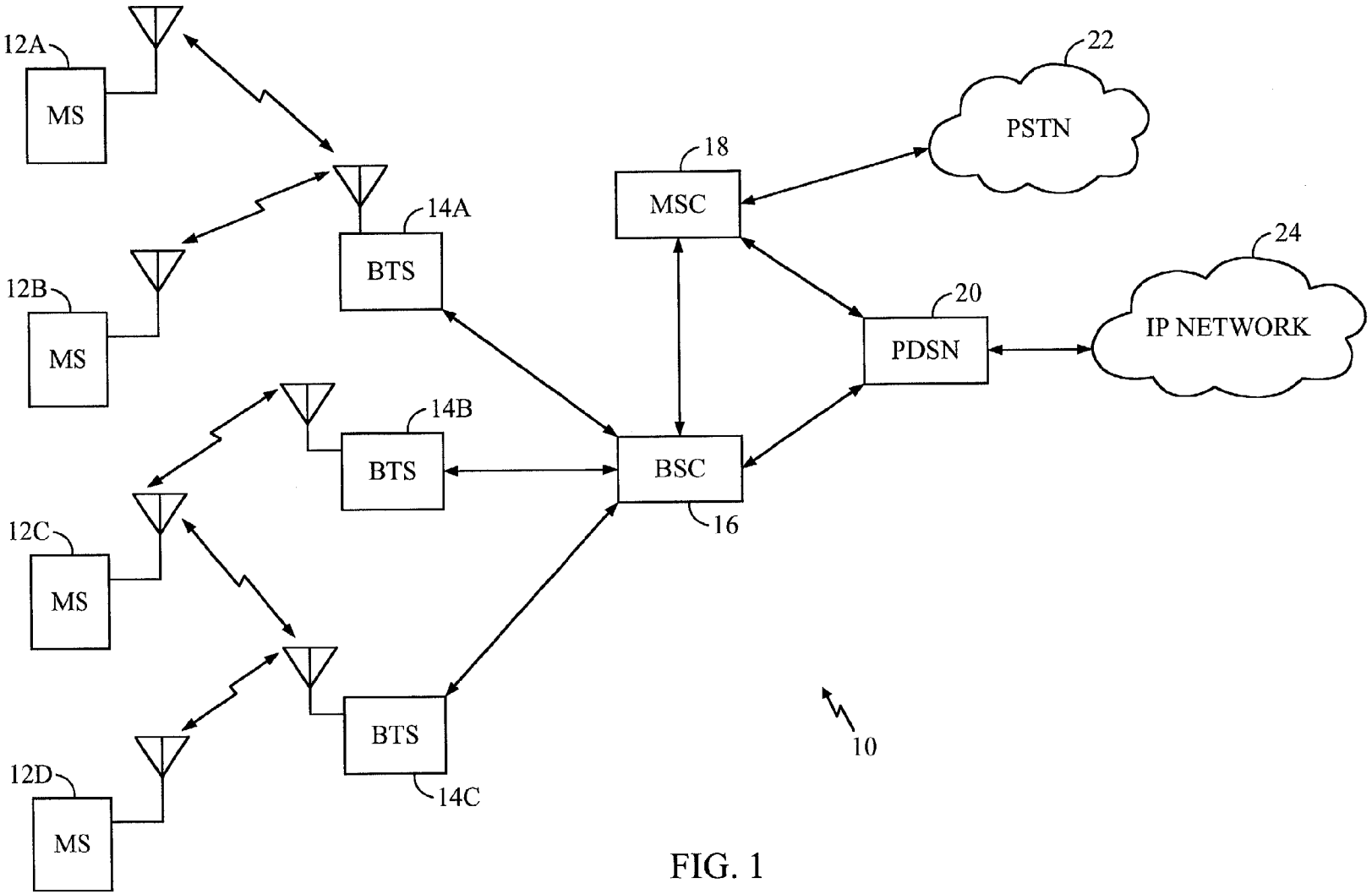
FIG. 1 is a diagram of a wireless communication system.

As illustrated in FIG. 1, a wireless communication network 10 generally includes a plurality of remote stations (also called subscriber units or mobile stations or user equipment) 12*a*-12*d*, a plurality of base stations (also called base station transceivers (BTSs) or Node B). 14*a*-14*c*, a base station controller (BSC) (also called radio network controller or packet control function 16), a mobile switching center (MSC) or switch 18, a packet data serving node (PDSN) or internetworking function (IWF) 20, a public switched telephone network (PSTN) 22 (typically a telephone company), and an Internet Protocol (IP) network 24 (typically the Internet). For purposes of simplicity, four remote stations 12*a*-12*d*, three base stations 14*a*-14*c*, one BSC 16, one MSC 18, and one PDSN 20 are shown. It would be understood by those skilled in the art that there could be any number of remote stations 12, base stations 14, BSCs 16, MSCs 18, and PDSNs 20.

In one embodiment the wireless communication network 10 is a packet data services network. The remote stations 12*a*-12*d* may be any of a number of different types of wireless communication device such as a portable phone, a cellular telephone that is connected to a laptop computer running IP-based Web-browser applications, a cellular telephone with associated hands-free car kits, a personal data assistant (PDA) running IP-based Web-browser applications, a wireless communication module incorporated into a portable computer, or a fixed location communication module such as might be found in a wireless local loop or meter reading system. In the most general embodiment, remote stations may be any type of communication unit.

The remote stations 12*a*-12*d* may advantageously be configured to perform one or more wireless packet data protocols such as described in, for example, the EIA/TIA/IS-707 standard. In a particular embodiment, the remote stations 12*a*-12*d* generate IP packets destined for the IP network 24 and encapsulates the IP packets into frames using a point-to-point protocol (PPP).

In one embodiment the IP network 24 is coupled to the PDSN 20, the PDSN 20 is coupled to the MSC 18, the MSC is coupled to the BSC 16 and the PSTN 22, and the BSC 16 is coupled to the base stations 14*a*-14*c* via wirelines configured for transmission of voice and/or data packets in accordance with any of several known protocols including, e.g., E1, T1, Asynchronous Transfer Mode (ATM), Internet Protocol (IP), Point-to-Point Protocol (PPP), Frame Relay, High-bit-rate Digital Subscriber Line (HDSL), Asymmetric Digital Subscriber Line (ADSL), or other generic digital subscriber line equipment and services (xDSL). In an alternate embodiment, the BSC 16 is coupled directly to the PDSN 20, and the MSC 18 is not coupled to the PDSN 20.

During typical operation of the wireless communication network 10, the base stations 14*a*-14*c* receive and demodulate sets of uplink signals from various remote stations 12*a*-12*d* engaged in telephone calls, Web browsing, or other data communications. Each uplink signal received by a given base station 14*a*-14*c* is processed within that base station 14*a*-14*c*. Each base station 14*a*-14*c* may communicate with a plurality of remote stations 12*a*-12*d* by modulating and transmitting sets of downlink signals to the remote stations 12*a*-12*d*. For example, as shown in FIG. 1, the base station 14*a* communicates with first and second remote stations 12*a*, 12*b* simultaneously, and the base station 14*c* communicates with third and fourth remote stations 12*c*, 12*d* simultaneously. The resulting packets are forwarded to the BSC 16, which provides call resource allocation and mobility management functionality including the orchestration of soft handoffs of a call for a particular remote station 12*a*-12*d* from one base station 14*a*-14*c* to another base station 14*a*-14*c*. For example, a remote station 12*c* is communicating with two base stations 14*b*, 14*c* simultaneously. Eventually, when the remote station 12*c* moves far enough away from one of the base stations 14*c*, the call will be handed off to the other base station 14*b*.

If the transmission is a conventional telephone call, the BSC 16 will route the received data to the MSC 18, which provides additional routing services for interface with the PSTN 22. If the transmission is a packet-based transmission such as a data call destined for the IP network 24, the MSC 18 will route the data packets to the PDSN 20, which will send the packets to the IP network 24. Alternatively, the BSC 16 will route the packets directly to the PDSN 20, which sends the packets to the IP network 24.

In a WCDMA system, the terminology of the wireless communication System components differs, but the functionality is the same. For example, a Base station can also be referred to as a Radio Network Controller (RNC) operating in a UTMS Terrestrial Radio Acess Network (U-TRAN), wherein "UTMS" is an acronym for Universal Mobile Telecommunications Systems.

In a WCDMA system, the terminology of the wireless communication system components differs, but the functionality is the same. For example, a base station can also be referred to as a Radio Network Controller (RNC) operating in a UMTS Terrestrial Radio Access Network (U-TRAN), wherein "UMTS" is an acronym for Universal Mobile Telecommunications Systems.

Typically, conversion of an analog voice signal to a digital signal is performed by an encoder and conversion of the digital signal back to a voice signal is performed by a decoder. In an exemplary CDMA system, a vocoder comprising both an encoding portion and a decoding portion is collated within remote stations and base stations. An exemplary vocoder is described in U.S. Pat. No. 5,414,796, entitled "Variable Rate Vocoder," assigned to the assignee of the present invention and incorporated by reference herein. In a vocoder, an encoding portion extracts parameters that relate to a model of human speech generation. The extracted parameters are then quantized and transmitted over a transmission channel. A decoding portion re-synthesizes the speech using the quantized parameters received over the transmission channel. The model is constantly changing to accurately model the time-varying speech signal.

Thus, the speech is divided into blocks of time, or analysis frames, during which the parameters are calculated. The parameters are then updated for each new frame. As used herein, the word "decoder" refers to any device or any portion of a device that can be used to convert digital signals that have been received over a transmission medium. The word "encoder" refers to any device or any portion of a device that can be used to convert acoustic signals into digital signals. Hence, the embodiments described herein can be implemented with vocoders of CDMA systems, or alternatively, encoders and decoders of non-CDMA systems.

The Code Excited Linear Predictive Coding (CELP) method is used in many speech compression algorithms, wherein a filter is used to model the spectral magnitude of the speech signal. A filter is a device that modifies the frequency spectrum of an input waveform to produce an output waveform. Such modifications can be characterized by the transfer function H(f)=Y(f)/X(f), which relates the modified output waveform y(t) to the original input waveform x(t) in the frequency domain.

With the appropriate filter coefficients, an excitation signal that is passed through the filter will result in a waveform that closely approximates the speech signal. The selection of optimal excitation signals does not affect the scope of the embodiments described herein and will not be discussed further. Since the coefficients of the filter are computed for each frame of speech using linear prediction techniques, the filter is subsequently referred to as the Linear Predictive Coding (LPC) filter. The filter coefficients are the coefficients of the transfer function:

$$A(z) = 1 - \sum_{i=1}^{L} A_i z^{-1},$$

wherein L is the order of the LPC filter.

Once the LPC filter coefficients $A_i$ have been determined, the LPC filter coefficients are quantized and transmitted to a destination, which will use the received parameters in a speech synthesis model.

One method for conveying the coefficients of the LPC filter to a destination involves transforming the LPC filter coefficients into Line Spectral Pair (LSP) parameters, which are then quantized and transmitted rather than the LPC filter coefficients. At the receiver, the quantized LSP parameters are transformed back into LPC filter coefficients for use in the speech synthesis model. Quantization is usually performed in the LSP domain because LSP parameters have better quantization properties than LPC parameters. For example, the ordering property of the quantized LSP parameters guarantees that the resulting LPC filter will be stable. The transformation of LPC coefficients into LSP coefficients and the benefits of using LSP coefficients are well known and are described in detail in the aforementioned U.S. Pat. No. 5,414,796.

However, the quantization of LSP coefficients is of interest in the instant document since LSP coefficient quantization can be performed in a variety of different ways, each for achieving different design goals. In general, one of two schemes is used to perform quantization of either LPC or LSP coefficients. The first method is scalar quantization (SQ) and the second method is vector quantization (VQ). The methods herein are described in terms of LSP coefficients, however, it should be understood that the methods can be applied to LPC coefficients and other types of filter coefficients as well. LSP coefficients are also referred to as Line Spectral Frequencies (LSF) in the art, and other types of filter coefficients used in speech encoding include, but are not limited to, Immittance Spectral Pairs (ISP) and Discrete Cosine Transforms (DCT).

Suppose a set of LSP coefficients $X=\{X_i\}$, wherein i=1, 2, . . . , L, can be used to model a frame of speech. If scalar quantization is used, then each component $X_i$ is individually quantized. If vector quantization is used, then the set $\{X_i; i=1, 2, \ldots, L\}$ is used as an entire vector X, which is then quantized. Scalar quantization is computationally simpler than VQ, but requires a very large number of bits in order to achieve an acceptable level of performance. Vector quantization is more complex, but requires a smaller bit-budget, i.e., the number of bits that are available to represent the quantized vector. For example, in a typical LSP quantization problem wherein the number of coefficients L is equal to 10 and the size of the bit-budget is N=30, then using scalar quantization would mean an allocation of only 3 bits per coefficient. Hence, each coefficient would have only 8 possible quantization values, which leads to very poor performance. If vector quantization is used, then the entire N=30 bits could be used to represent a vector, which allows for 230 possible candidate values from which to select a representation of the vector.

However, searching through $2^{30}$ possible candidate values for a best fit is beyond the resources of any practical system. In other words, the direct VQ scheme is not feasible for practical implementations of LSP quantization. Accordingly, variations of two other VQ techniques, Split-VQ (SPVQ) and Multi-Stage VQ (MSVQ), are widely used.

Figure 2A:
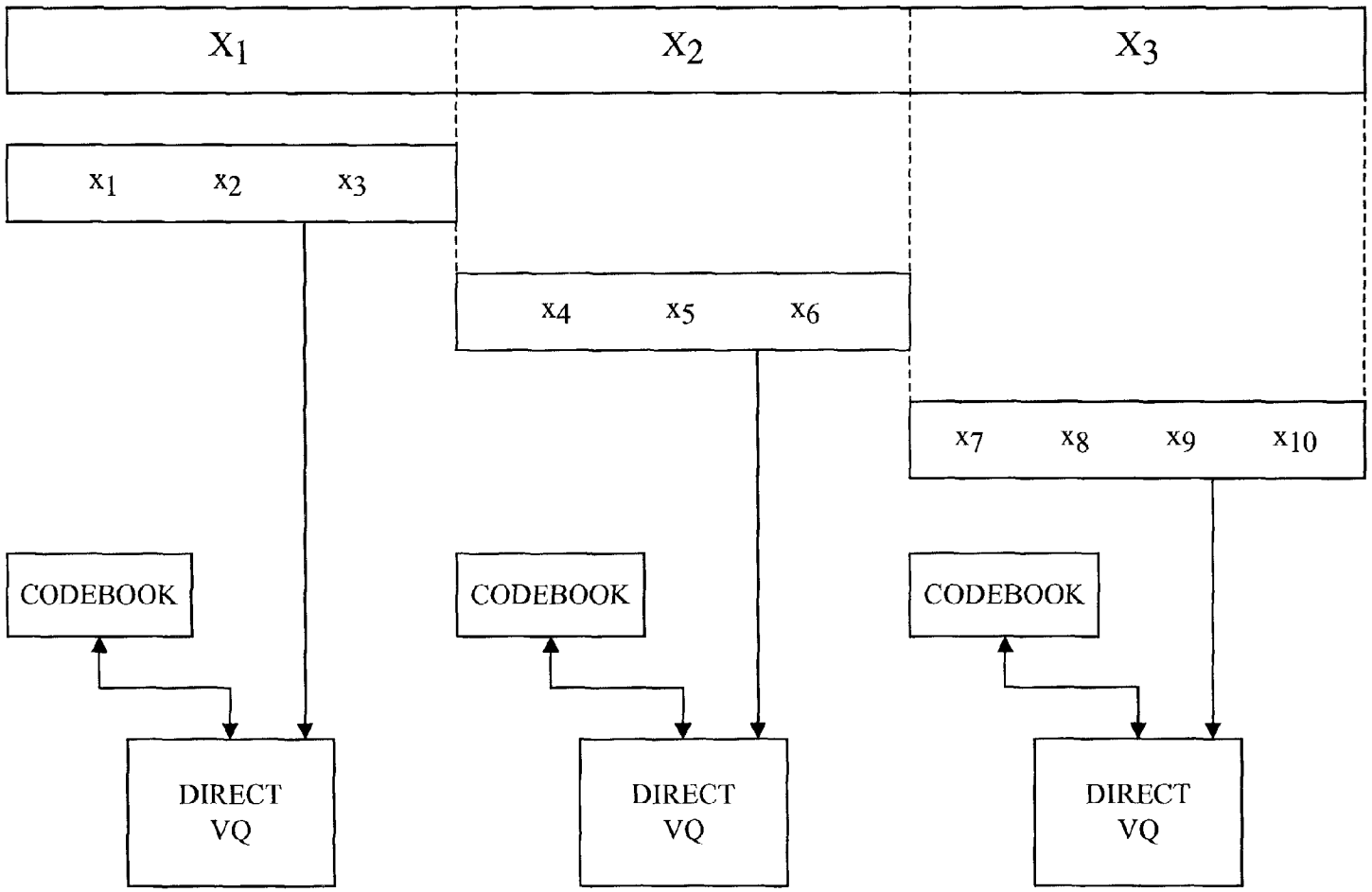
(PRIOR ART) FIG. 2A
FIGS. 2A and 2B are block diagrams of a split vector quantization scheme and a multi-stage vector quantization scheme, respectively.

SPVQ reduces the complexity and memory requirements of quantization by splitting the direct VQ scheme into a set of smaller VQ schemes. In SPVQ, the input vector X is split into a number of "sub-vectors" $X_j$, j=1,2, . . . ,$N_s$, where $N_s$ is the number of sub-vectors, and each sub-vector $X_j$ is quantized separately using direct VQ. FIG. 2A is a block diagram of the SPVQ scheme. For example, suppose a SPVQ scheme is used to quantize a vector of length L=10 with a bit-budget N=30. In one implementation, the input vector X is split into 3 sub-vectors $X_1=(x_1\ x_2\ x_3)$, $X_2=(x_4\ x_5\ x_6)$, and $X_3=(x_7\ x_8\ x_9\ x_{10})$. Each sub-vector is quantized by one of three direct VQs, wherein each direct VQ uses 10 bits. Hence the quantization codebook comprises 1024 entries or "codevectors." In this example, the memory usage is proportional to $2^{10}$ codevectors multiplied by 10 words/codevector=10,240 words. Moreover, the search complexity is equally reduced. However, the performance of such an SPVQ scheme will be inferior to the direct VQ scheme, since there are only 1024 choices for each input vector, rather than $2^{30}$=1,073,741,824 choices. It should be noted that in an SPVQ quantizer, the power to search in a high dimensional (L) space is lost by partitioning the L-dimensional space into smaller sub-spaces. Therefore, the ability to fully exploit the entire intra-component correlation in the L-dimensional input vector is lost.

Figure 2B:
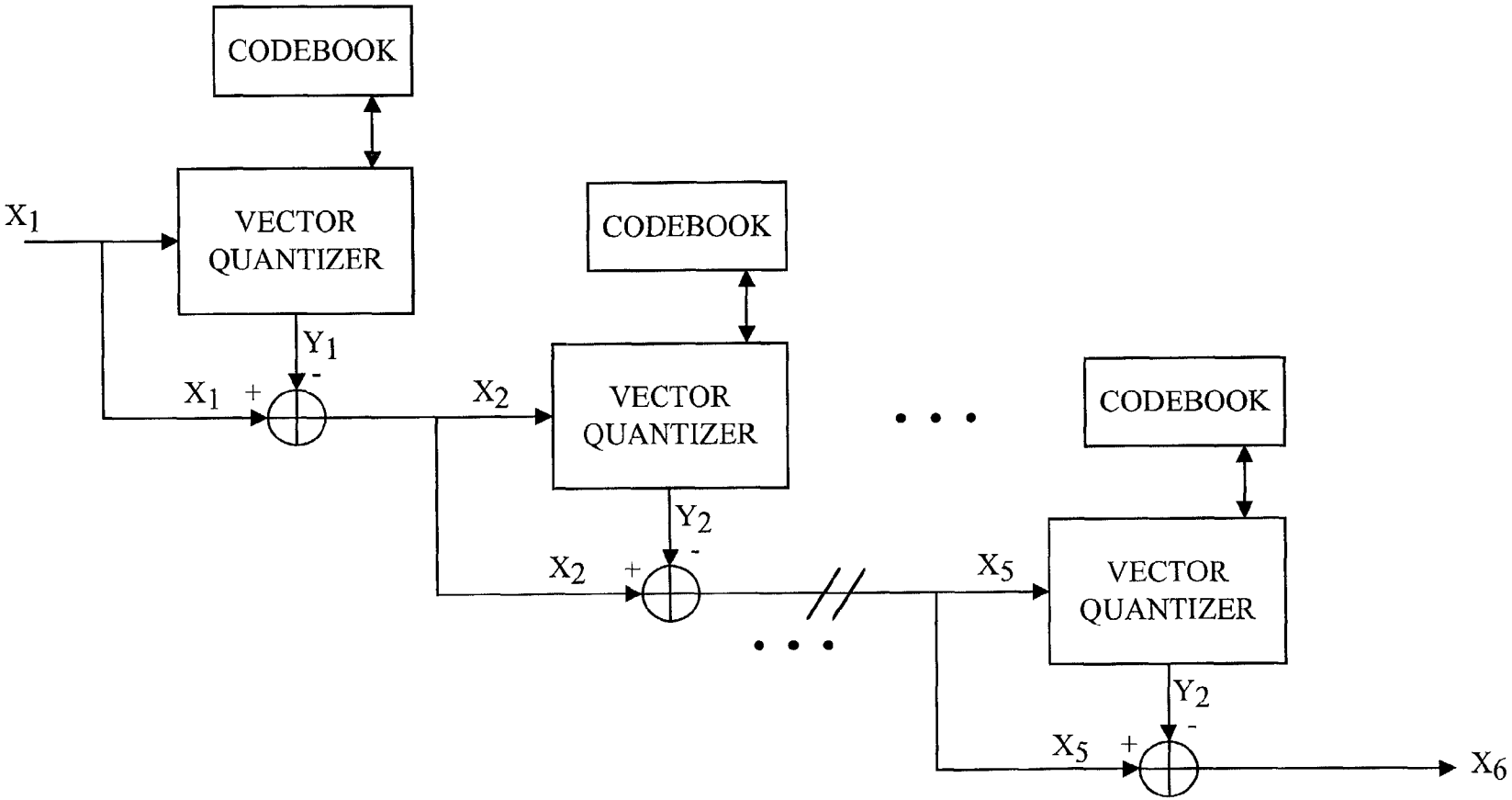
(PRIOR ART) FIG. 2B

The MSVQ scheme offers less complexity and memory usage than the SPVQ scheme because the quantization is performed in several stages. The input vector is kept to the original length L. The output of each stage is used to determine a difference vector that is input to the next stage. At each stage, the difference vector is approximated using a relatively small codebook. FIG. 2B is a block diagram of the MSVQ scheme. For example, in one example, a six (6) stage MSVQ is used for quantizing an LSP vector of length 10 with a bit-budget of 30 bits. Each stage uses 5 bits, resulting in a codebook that has 32 codevectors. Let $X_i$ be the input vector of the $i^{th}$ stage and $Y_i$ be the quantized output of the $i^{th}$ stage, wherein $Y_i$ is the best codevector obtained from the $i^{th}$ stage VQ codebook $CB_i$. Then the input to the next stage will be the difference vector $X_{i+1}=X_i-Y_i$. If each stage is allocated 5 bits, then the codebooks for each stage would comprise $2^5=32$ codevectors.

The use of multiple stages allows the input vector to be approximated stage by stage. At each stage the input dynamic range becomes smaller and smaller. The computational complexity and memory usage is proportional to 6 stages×32 codevectors/stage×10 words/codevector=1920 words. Hence, the MSVQ scheme has a smaller number complexity and memory requirement than the SPVQ scheme. The multi-stage structure of MSVQ also provides robustness across a wide variance of input vector statistics. However, the performance of MSVQ is sub-optimal due to the limited size of the codebook and due to the "greedy" nature of the codebook search. MSVQ finds the "best" approximation of the input vector at each stage, creates a difference vector, and then finds the "best" representative for the difference vector at the next stage. However, it is observed that the determination of the "best" representative at each stage does not necessarily mean that the final result will be the closest approximation to the original, first input vector. The inflexibility of selecting only the best candidate in each stage hurts the overall performance of the scheme.

One solution to the weaknesses in SPVQ and MSVQ is to combine the two vector quantization schemes into one scheme. One combined implementation is the Predictive Multi-Stage Vector Quantization (PMSVQ) scheme. Similar to the MSVQ, the output of each stage is used to determine a difference vector that is input into the next stage. However, rather than approximating each input at each stage as a whole vector, the input at each stage is approximated as a group of subvectors, such as described above for the SPVQ scheme. In addition, the output of each stage is stored for use at the end of the scheme, wherein the output of each stage is considered in conjunction with other stage outputs in order to determine the "best" overall representation of the initial vector. Thus, the PMSVQ scheme is favored over the MSVQ scheme alone since the decision as to the "best" overall representative vector is delayed until the end of the last stage. However, the PMSVQ scheme is not optimal due to the amount of spectral distortion generated by the multi-stage structure.

Another combined implementation is the Split Multi-Stage Vector Quantization (SMSVQ) as described in U.S. Pat. No. 6,148,283, entitled, "METHOD AND APPARATUS USING MULTI-PATH MULTI-STAGE VECTOR QUANTIZER," which is incorporated by reference herein and assigned to the assignee of the present invention. In the SMSVQ scheme, rather than using a whole vector as the input at the initial stage, the vector is split into subvectors. Each subvector is then processed through a multi-stage structure. Hence, there are parallel, multi-stage structures in the quantization scheme. The dimension of each input subvector for each stage can remain the same, or can be split even further into smaller subvectors.

For vocoders that are to have frames of wideband signals as input, the quantization of the LSP coefficients requires a higher number of bits than for narrowband signals, due to the higher dimensionality needed to model the wideband signal. For example, rather than using an LPC filter of order 10 for a narrowband signal, i.e., 10 filter coefficients in the transfer function, a larger order LPC filter is required for modeling a wideband signal frame. In one implementation of a wideband vocoder, an LPC filter with 16 coefficients is used, along with a bit-budget of 32 bits. In this implementation, a direct VQ codebook search would entail a search through $2^{32}$ codevectors. It should be noted that the order of the LPC filter and the bit-budgets are system parameters that can be altered without affecting the scope of the embodiments herein. Hence, the embodiments can be used in conjunction with filters with more or less taps.

The embodiments that are described herein are for creating a new bandwidth-adaptive quantization scheme for quantizing the spectral representations used by a wideband vocoder. For example, the bandwidth-adaptive quantization scheme can be used to quantize LPC filter coefficients, LSP/LSF coefficients, ISP/ISF coefficients, DCT coefficients or cepstral coefficients, which can all be used as spectral representations. Other examples also exist. The new bandwidth-adaptive scheme can be used to reduce the number of bits required to encode the acoustic wideband signal while maintaining and/or improving the perceptual quality of the synthesized wideband signal. These goals are accomplished by using a signal classification scheme and a spectral analysis scheme to variably allocate bits that will be used to represent specific portions of the frequency spectrum. The principles of the bandwidth-adaptive quantization scheme can be extended for application in the various other vector quantization schemes, such as the ones described above.

In a first embodiment, a classification of the acoustic signal within a frame is performed to determine whether the acoustic signal is a speech signal, a nonspeech signal, or a inactive speech signal. Examples of inactive speech signals are silence, background noise, or pauses between words. Nonspeech may comprise music or other nonhuman acoustic signal. Speech can comprise voiced speech, unvoiced speech or transient speech. Various methods exist for determining upon the type of acoustic activity that may be carried by the frame, based on such factors as the energy content of the frame, the periodicity of the frame, etc.

Voiced speech is speech that exhibits a relatively high degree of periodicity. The pitch period is a component of a speech frame and may be used to analyze and reconstruct the contents of the frame. Unvoiced speech typically comprises consonant sounds. Transient speech frames are typically transitions between voiced and unvoiced speech. Speech frames that are classified as neither voiced nor unvoiced speech are classified as transient speech. It would be understood by those skilled in the art that any reasonable classification scheme could be employed.

Classifying the speech frames is advantageous because different encoding modes can be used to encode different types of speech, resulting in more efficient use of bandwidth in a shared channel such as the communication channel. For example, as voiced speech is periodic and thus highly predictive, a low-bit-rate, highly predictive encoding mode can be employed to encode voiced speech. The end result of the classification is a determination of the best type of vocoder output frame to be used to convey the signal parameters. In the variable rate vocoder of aforementioned U.S. Pat. No. 5,414,796, the parameters are carried in vocoder frames that are referred to as full rate frames, half rate frames, quarter rate frames, or eighth rate frames, depending upon the classification of the signal.

One method for using speech classification to select the type of vocoder frame for carrying the parameters of a speech frame is presented in co-pending U.S. patent application Ser. No. 09/733,740, entitled, "METHOD AND APPARATUS FOR ROBUST SPEECH CLASSIFICATION," which is incorporated by reference herein and assigned to the assignee of the present invention. In this co-pending patent application, a voice activity detector, an LPC analyzer, and an open loop pitch estimator are configured to output information that is used by a speech classifier to determine various past, present and future speech frame energy parameters. These speech frame energy parameters are then used to more accurately and robustly classify acoustic signals into speech or nonspeech modes. The classification may also be based on a mode of the previous frame. In one embodiment, the speech classifier internally generates a look ahead frame energy parameter, which may contain energy values from a portion of the current frame and a portion of the next frame of output speech. In one embodiment, the look ahead frame energy parameter represents the energy in the second half of the current frame and the energy in the first half of the next frame of output speech. In one embodiment, the speech classifier compares the energy of the current frame and the energy of the next frame to identify end of speech and beginning of speech conditions, or up transient and down transient speech modes. In one embodiment, the speech classifier internally generates a band energy ratio parameter, defined as log 2(EL/EH), where EL is the low band current frame energy from 0 to 2 kHz, and EH is the high band current frame energy from 2 kHz to 4 kHz.

After the classification of the acoustic signal is performed for an input frame, the spectral contents of the input frame are then examined in accordance with the embodiments described herein. As is generally known in the art, an acoustic signal often has a frequency spectrum that can be classified as low-pass, band-pass, high-pass or stop-band. For example, a voiced speech signal generally has a low-pass frequency spectrum while an unvoiced speech signal generally has a high-pass frequency spectrum. For low-pass signals, a frequency die-off occurs at the higher end of the frequency range. For band-pass signals, frequency die-offs occur at the low end of the frequency range and the high end of the frequency range. For stop-band signals, frequency die-offs occur in the middle of the frequency range. For high-pass signals, a frequency die-off occurs at the low end of the frequency range. As used herein, the term "frequency die-off" refers to a substantial reduction in the magnitude of frequency spectrum within a narrow frequency range, or alternatively, an area of the frequency spectrum wherein the magnitude is less than a threshold value. The actual definition of the term is dependent upon the context in which the term is used herein.

The embodiments are for determining the type of acoustic signal and the type of frequency spectrum exhibited by the acoustic signal in order to selectively delete parameter information. The bits that would otherwise be allocated to the deleted parameter information can then be re-allocated to the quantization of the remaining parameter information, which results in an improvement of the perceptual quality of the synthesized acoustic signal. Alternatively, the bits that would have been allocated to the deleted parameter information are dropped from consideration, i.e., those bits are not transmitted, resulting in an overall reduction in the bit rate.

In one embodiment, predetermined split locations are set at frequencies wherein certain die-offs are expected to occur, due to the classification of the acoustic signal. As used herein, split locations in the frequency spectrum are also referred to as boundaries of analysis regions. The split locations are used to determine how the input vector X will be split into a number of "sub-vectors" $X_j$, j=1, 2, . . . , $N_s$, as in the SPVQ scheme described above. The coefficients of the subvectors that are in designated deletion locations are then discarded, and the allocated bits for those discarded coefficients are either dropped from the transmission, or reallocated to the quantization of the remaining subvector coefficients.

For example, suppose that a vocoder is configured to use an LPC filter of order 16 to model a frame of acoustic signal. Suppose further that in an SPVQ scheme, a sub-vector of 6 coefficients are used to describe the low-pass frequency components, a sub-vector of 6 coefficients are used to describe the band-pass frequency components, and a sub-vector of 4 coefficients are used to describe the high-pass frequency components. The first sub-vector codebook comprises 8-bit codevectors, the second sub-vector codebook comprises 8-bit codevectors and the third sub-vector codebook comprises 6-bit codevectors.

The present embodiments are for determining whether a section of the split vector, i.e., one of the sub-vectors, coincides with a frequency die-off. If there is a frequency die-off, as determined by the acoustic signal classification scheme, then that particular sub-vector is dropped. In one embodiment, the dropped sub-vector lowers the number of codevector bits that need to be transmitted over a transmission channel. In another embodiment, the codevector bits that were allocated to the dropped sub-vector are re-allocated to the remaining subvectors. In the example presented above, if the analysis frame carried a low-pass signal with a die-off frequency at 5 kHz, then according to one embodiment of the bandwidth-adaptive scheme, 6 bits are not used for transmitting codebook information or alternatively, those 6 codebook bits are re-allocated to the remaining codebooks, so that the first subvector codebook comprises 11-bit codevectors and the second subvector codebook comprises 11-bit codevectors. The implementation of such a scheme could be implemented with an embedded codebook to save memory. An embedded codebook scheme is one in which a set of smaller codebooks is embedded into a larger codebook.

Figure 3:
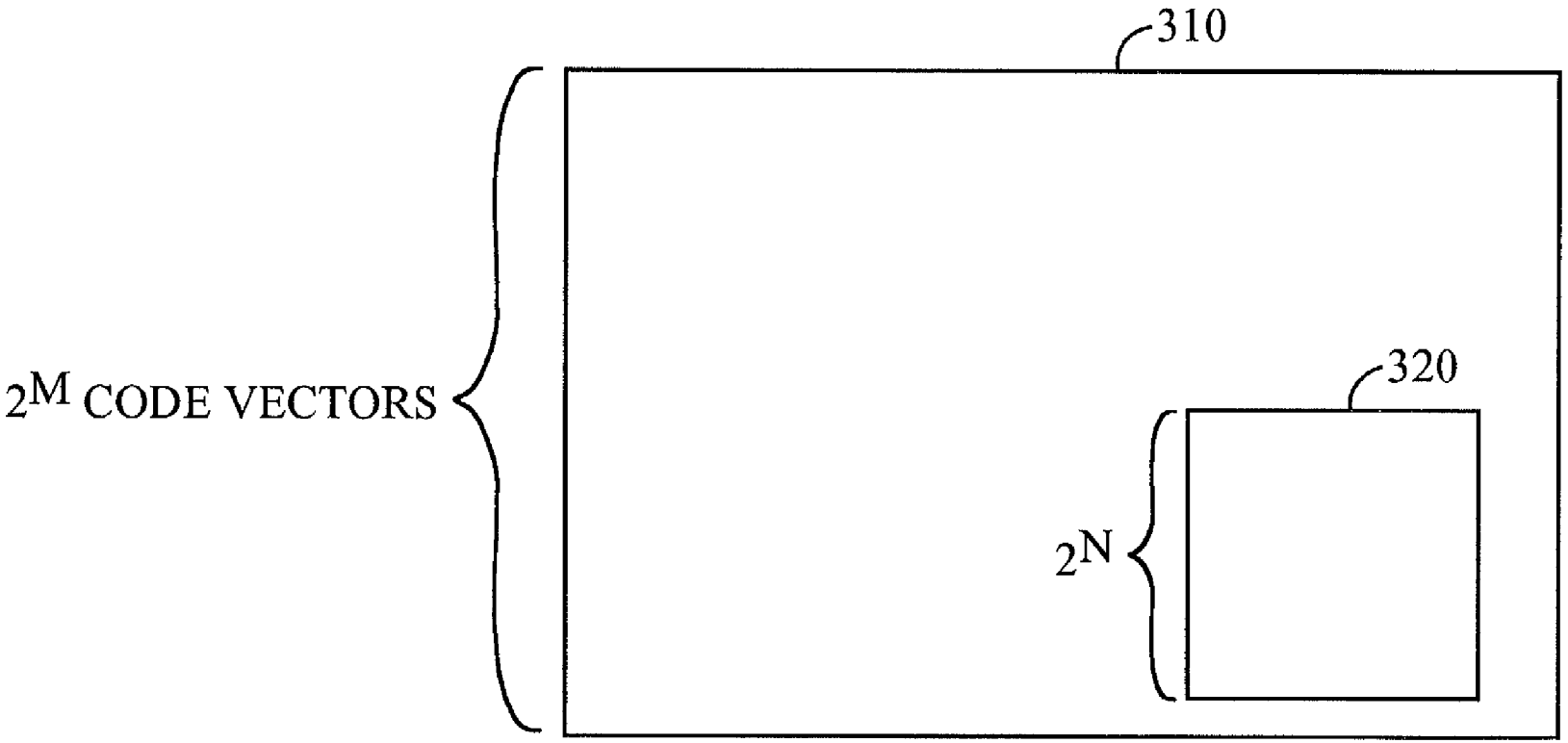
FIG. 3 is a block diagram of an embedded codebook.

An embedded codebook can be configured as in FIG. 3. A super codebook 310 comprises $2^M$ codevectors. If a vector requires a bit-budget less than M bits for quantization, then an embedded codebook 320 of size less than $2^M$ can be extracted from the super codebook. Different embedded codebooks can be assigned to different subvectors for each stage. This design provides efficient memory savings.

Figure 4:
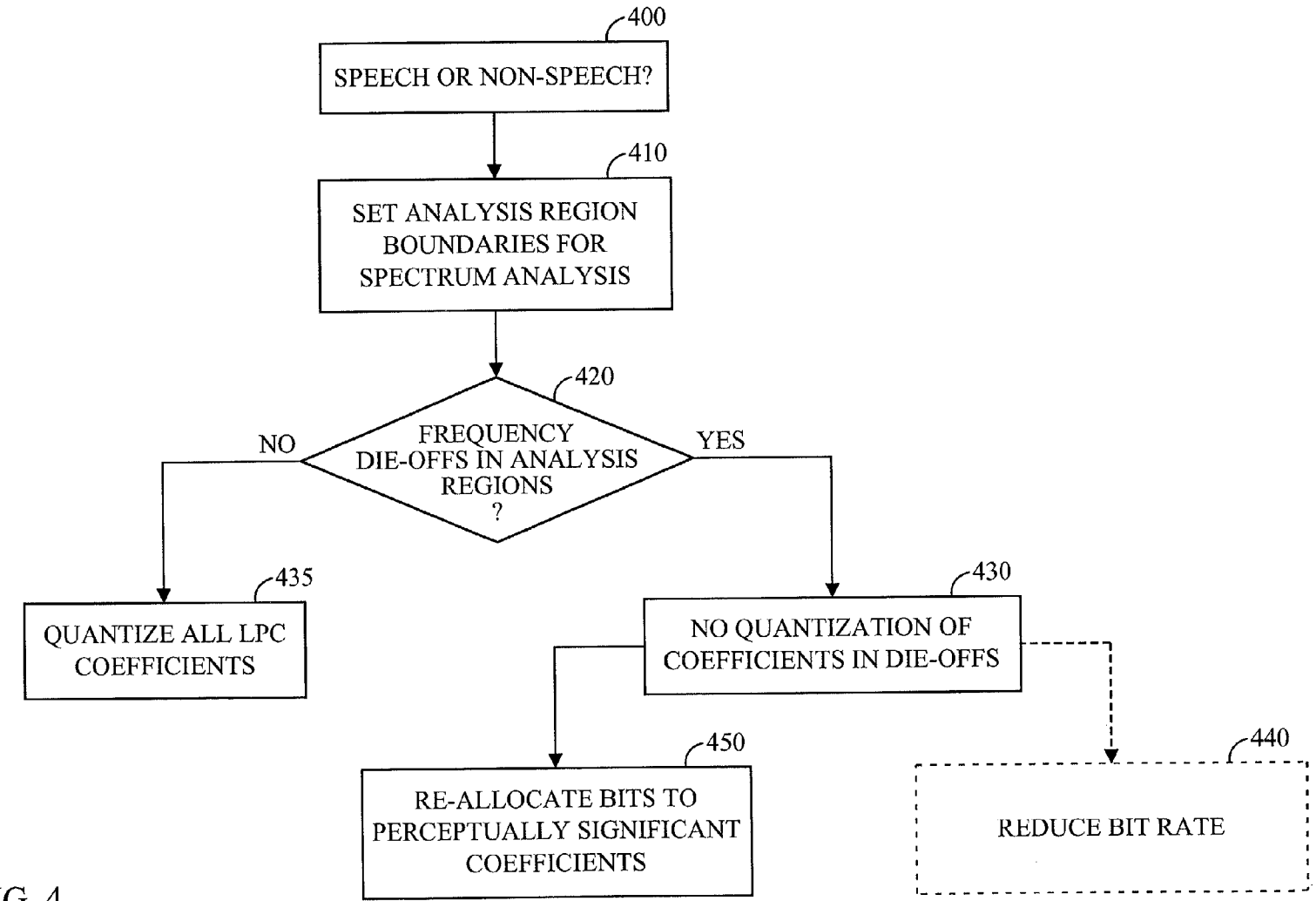
FIG. 4 is a block diagram of a generalized bandwidth-adaptive quantization scheme.

FIG. 4 is a block diagram of a generalized bandwidth-adaptive quantization scheme. At step 400, an analysis frame is classified according to a speech or nonspeech mode. At step 410, the classification information is provided to a spectral analyzer, which uses the classification information to split the frequency spectrum of the signal into analysis regions. At step 420, the spectral analyzer determines if any of the analysis regions coincide with a frequency die-off. If none of the analysis regions coincide with a frequency die-off, then at step 435, the LPC coefficients associated with the analysis frame are all quantized. If any of the analysis regions coincide with a frequency die-off, then at step 430, the LPC coefficients associated with the frequency die-off regions are not quantized. In one embodiment, the program flow proceeds to step 440, wherein only the LPC coefficients not associated with the frequency die-off regions are quantized and transmitted. In an alternate embodiment, the program flow proceeds to step 450, wherein the quantization bits that would otherwise be reserved for the frequency die-off region are instead re-allocated to the quantization of coefficients associated with other analysis regions.

Figure 5A:
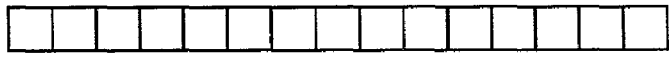
FIGS. 5A, 5B, 5C, 5D, and 5E are representations of 16 coefficients aligned with a low-pass frequency spectrum, a high-pass frequency spectrum, a stop-band frequency spectrum, and a band-pass frequency spectrum, respectively.
Figure 5B:
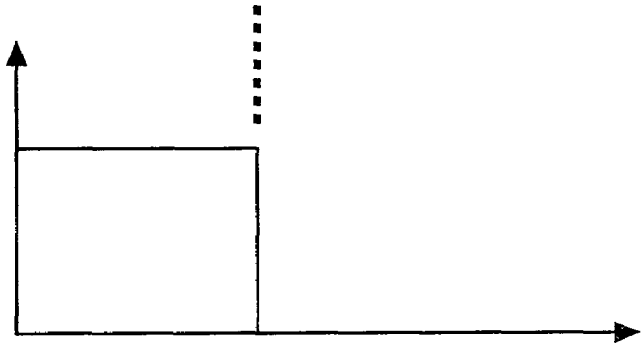
Figure 5C:
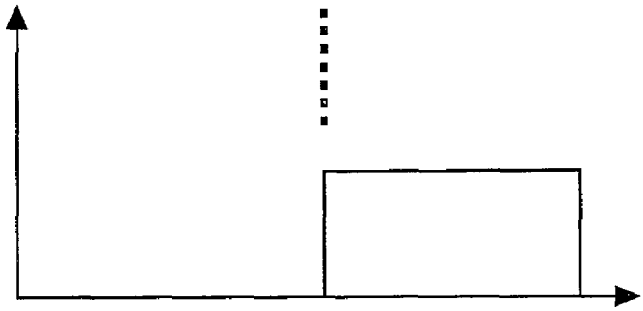
Figure 5D:
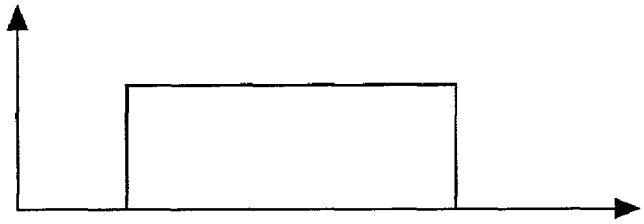
Figure 5E:
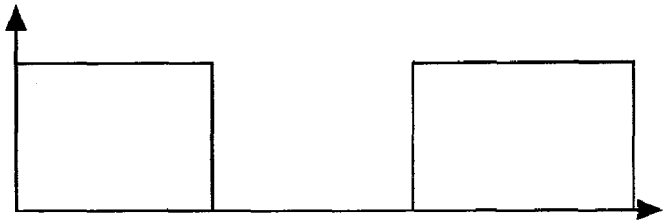

FIG. 5A is a representation of 16 coefficients aligned with a low-pass frequency spectrum (FIG. 5B), a high-pass frequency spectrum (FIG. 5C), a band-pass frequency spectrum (FIG. 5D), and a stop-band frequency spectrum (FIG. 5E). Suppose that a classification is performed for an analysis frame indicating that the analysis frame carries voiced speech. Then the system would be configured in accordance with one aspect of the embodiment to select the low-pass frequency spectrum model to determine whether to allocate quantization bits for the analysis region above the split location, i.e., 5 kHz in the above example. The spectrum would then be analyzed between 5 kHz and 8 kHz to determine whether a perceptually insignificant portion of the acoustic signal exists in that region. If the signal is perceptual insignificant in that region, then the signal parameters are quantized and transmitted without any representation of the insignificant portion of the signal. The "saved" bits that are not used to represent the perceptually insignificant portions of the signal can be re-allocated to represent the coefficients of the remaining portion of the signal. For example, Table 1 shows an alignment of coefficients to frequencies, which were selected for a low-pass signal. Other alignments are possible for signals with different spectral characteristics.

TABLE 1

Coefficient Alignments for Low-Pass Signal

| Hz | Dimensionality |
|---|---|
| 3000 | 8 coefficients |
| 4000 | 10 coefficients |
| 5000 | 12 coefficients |
| 6000 | 14 coefficients |

If there is a frequency die-off above 5 kHz, then only 12 coefficients are needed to convey information representing the low-pass signal. The remaining 4 coefficients need not be transmitted according to the embodiments described herein. According to one embodiment, the bits allocated for the subvector codebook associated with the "lost" 4 coefficients are instead distributed to the other subvector codebooks.

Hence, there is a reduction of the number of bits for transmission or an improvement in the acoustic quality of the remaining portion of the signal. In either case, the dropped subvector results in "lost" signal information that will not be transmitted. The embodiments are further for substituting "filler" into those portions that have been dropped in order to facilitate the synthesis of the acoustic signal. If dimensionality is dropped from a vector, then dimensionality must be added to the vector in order to accurately synthesize the acoustic signal.

In one embodiment, the filler can be generated by determining the mean coefficient value of the dropped subvector. In one aspect of this embodiment, the mean coefficient value of the dropped subvector is transmitted along with the signal parameter information. In another aspect of this embodiment, the mean coefficient values are stored in a shared table, at both a transmission end and a receiving end. Rather than transmitting the actual mean coefficient value along with the signal parameters, an index identifying the placement of a mean coefficient value in the table is transmitted. The receiving end can then use the index to perform a table lookup to determine the mean coefficient value. In another embodiment, the classification of the analysis frame provides sufficient information for the receiving end to select an appropriate filler subvector.

In another embodiment, the filler subvector can be a generic model that is generated at the decoder without further information from the transmitting party. For example, a uniform distribution can be used as the filler subvector. In another embodiment, the filler subvector can be past information, such as noise statistics of a previous frame, which can be copied into the current frame.

It should be noted that the substitution processes described above are applicable for use at the analysis-by-synthesis loop at the transmitting side and the synthesis process at a receiver.

Figure 6:
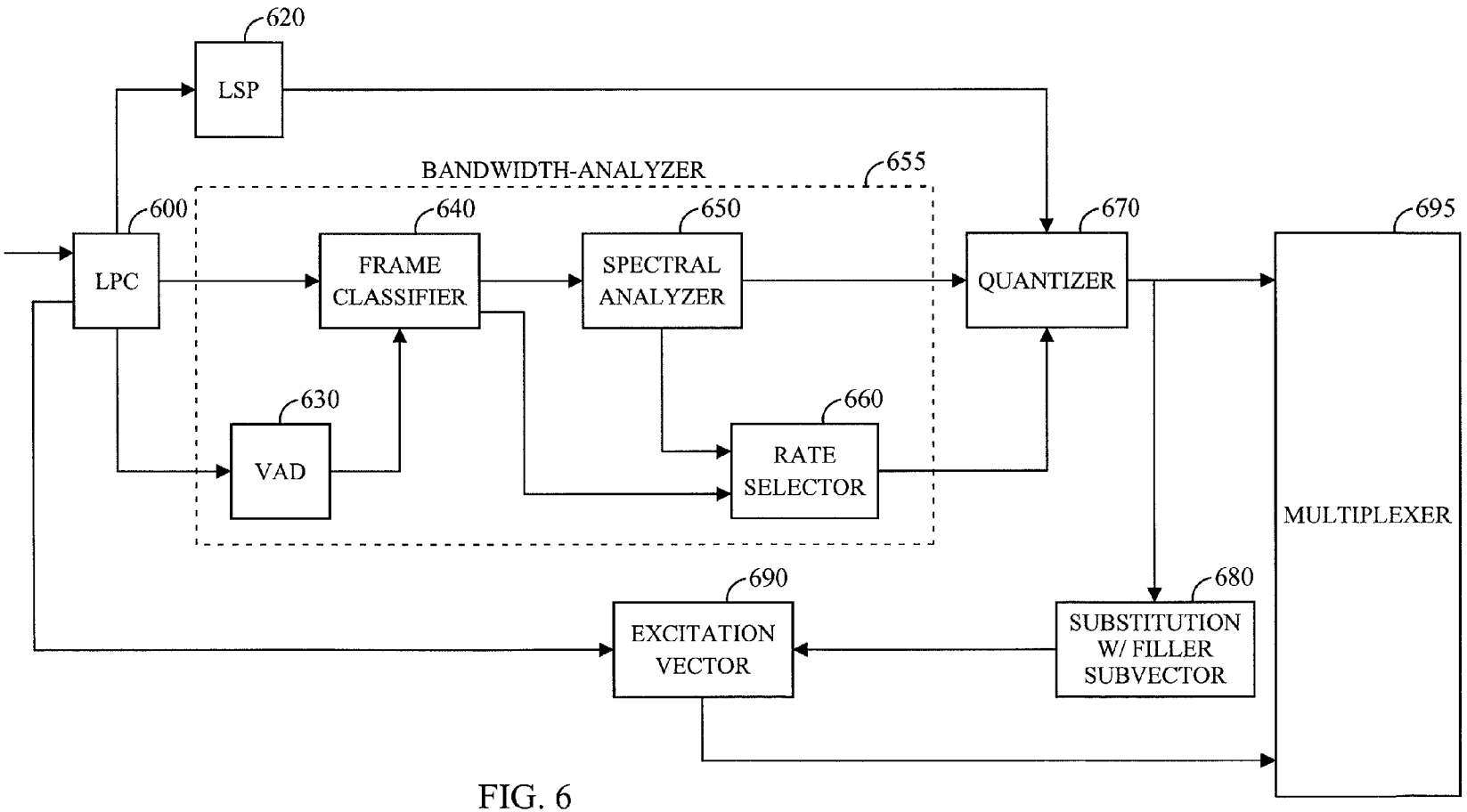
FIG. 6 is a block diagram of the functional components of a vocoder that is configured in accordance with the new bandwidth-adaptive quantization scheme.

FIG. 6 is a block diagram of the functional components of a vocoder that is configured in accordance with the new bandwidth-adaptive quantization scheme. A frame of a wideband signal is input into an LPC Analysis Unit 600 to determine LPC coefficients. The LPC coefficients are input to an LSP Generation Unit 620 to determine the LSP coefficients. The LPC coefficients are also input into a Voice Activity Detector (VAD) 630, which is configured for determining whether the input signal is speech, nonspeech or inactive speech. Once a determination is made that speech is present in the analysis frame, the LPC coefficients and other signal information are then input to a Frame Classification Unit 640 for classification as being voiced, unvoiced, or transient. Examples of Frame Classification Units are provided in above-referenced U.S. Pat. No. 5,414,796.

The output of the Frame Classification Unit 640 is a classification signal that is sent to the Spectral Content Unit 650 and the Rate Selection Unit 660. The Spectral Content Unit 650 uses the information conveyed by the classification signal to determine the frequency characteristics of the signal at specific frequency bands, wherein the bounds of the frequency bands are set by the classification signal. In one aspect, the Spectral Content Unit 650 is configured to determine whether a specified portion of the spectrum is perceptually insignificant by comparing the energy of the specified portion of the spectrum to the entire energy of the spectrum. If the energy ratio is less than a predetermined threshold, then a determination is made that the specified portion of the spectrum is perceptually insignificant. Other aspects exist for examining the characteristics of the frequency spectrum, such as the examination of zero crossings. Zero crossings are the number of sign changes in the signal per frame. If the number of zero crossings in a specified portion is low, i.e., less than a predetermined threshold amount, then the signal probably comprises voiced speech, rather than unvoiced speech. In another aspect, the functionality of the Frame Classification Unit 640 can be combined with the functionality of the Spectral Content Unit 650 to achieve the goals set out above.

The Rate Selection Unit 660 uses the classification information from the Frame Classification Unit 640 and the spectrum information of the Spectral Content Unit 650 to determine whether signal carried in the analysis frame can be best carried by a full rate frame, half rate frame, quarter rate frame, or an eighth rate frame. Rate Selection Unit 660 is configured to perform an initial rate decision based upon the Frame Classification Unit 640. The initial rate decision is then altered in accordance with the results from the Spectral Content Unit 650. For example, if the information from the Spectral Content Unit 650 indicates that a portion of the signal is perceptually insignificant, then the Rate Selection Unit 660 may be configured to select a smaller vocoder frame than originally selected to carry the signal parameters.

In one aspect of the embodiment, the functionality of the VAD 630, the Frame Classification Unit 640, the Spectral Content Unit 650 and the Rate Selection Unit 660 can be combined within a Bandwidth Analyzer 655.

A Quantizer 670 is configured to receive the rate information from the Rate Selection Unit 660, spectral content information from the Spectral Content Unit 650, and LSP coefficients from the LSP Generation Unit 620. The Quantizer 670 uses the frame rate information to determine an appropriate quantization scheme for the LSP coefficients and uses the spectral content information to determine the quantization bit-budgets of specific, ordered groups of filter coefficients. The output of the Quantizer 670 is then input into a multiplexer 695.

In linear predictive coders, the output of the Quantizer 670 is also used for generating optimal excitation vectors in an analysis-by-synthesis loop, wherein a search is performed through the excitation vectors in order to select an excitation vector that minimizes the difference between the signal and the synthesized signal. In order to perform the synthesis portion of the loop, the Excitation Generator 690 must have an input of the same dimensionality as the original signal. Hence, at a Substitution Unit 680, a "filler" subvector, which can be generated according to some of the embodiments described above, is combined with the output of the Quantizer 670 to supply an input to the Excitation Generator 690. Excitation Generator 690 uses the filler subvector and the LPC coefficients from LPC Analysis Unit 600 to select an optimal excitation vector. The output of the Excitation Generator 690 and the output of the Quantizer 670 are input into a multiplexer element 695 to be combined. The output of the multiplexer 695 is then encoded and modulated for transmission to a receiver.

In one type of spread spectrum communication system, the output of the multiplexer 695, i.e., the bits of a vocoder frame, is convolutionally or turbo encoded, repeated, and punctured to produce a sequence of binary code symbols. The resulting code symbols are interleaved to obtain a frame of modulation symbols. The modulation symbols are then Walsh covered and combined with a pilot sequence on the orthogonal-phase branch, PN-Spread, baseband filtered, and modulated onto the transmit carrier signal.

Figure 7:
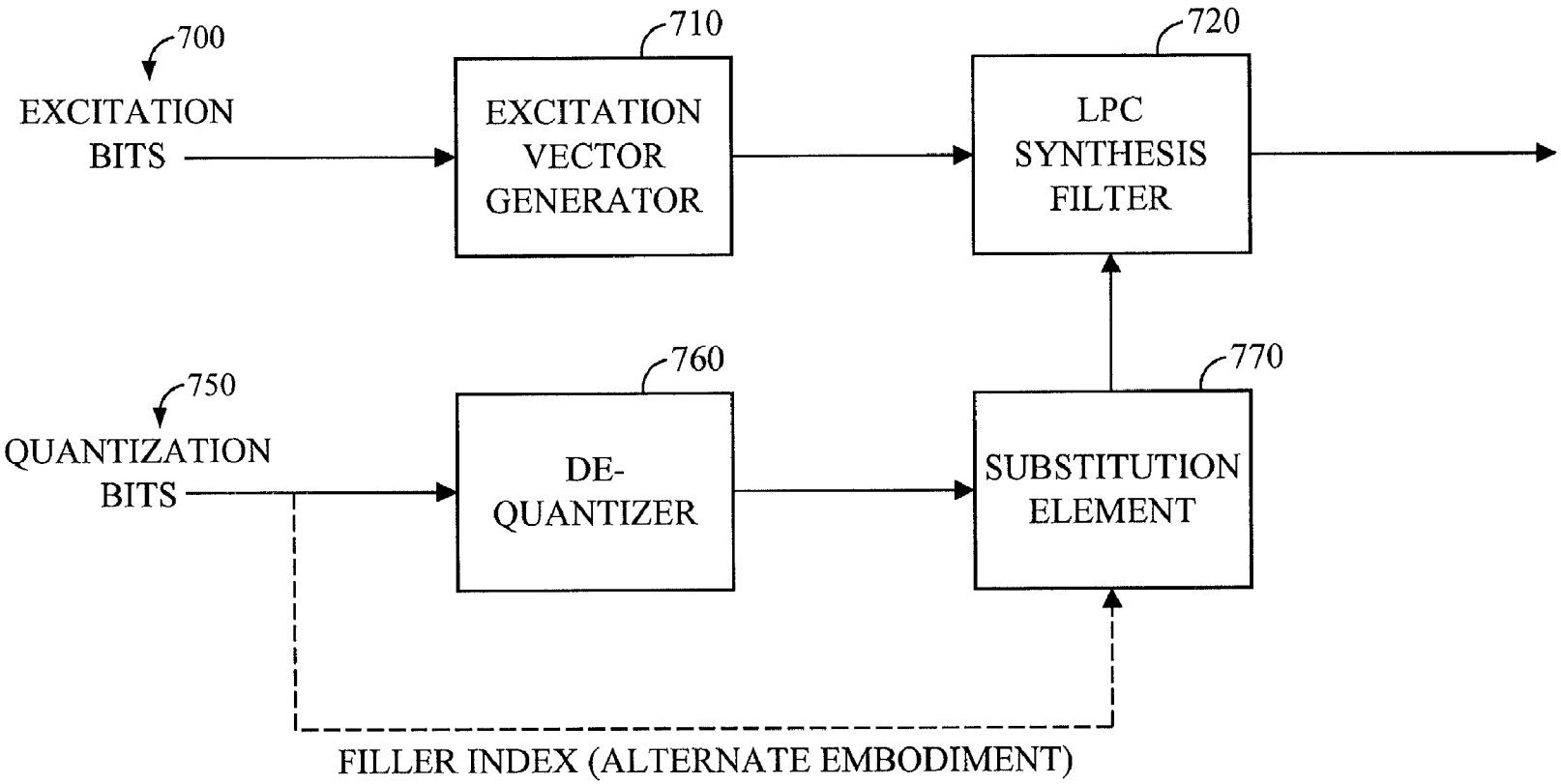
FIG. 7 is a block diagram of the decoding process at a receiving end.

FIG. 7 is a functional block diagram of the decoding process at a receiving end. A stream of received Excitation bits 700 are input to an Excitation Generator Unit 710, which generates excitation vectors that will be used by an LPC Synthesis Unit 720 to synthesis an acoustic signal. A stream of received quantization bits 750 are input to a De-Quantizer 760. The De-Quantizer 760 generates spectral representations, i.e., coefficient values of whichever transformation was used at the transmission end, which will be used to generate an LPC filter at LPC Synthesis Unit 720. However, before the LPC filter is generated, a filler subvector may be needed to complete the dimensionality of the LPC vector. Substitution element 770 is configured to receive spectral representation subvectors from the De-Quantizer 760 and to add a filler subvector to the received subvectors in order to complete the dimensionality of a whole vector. The whole vector is then input to the LPC Synthesis Unit 720.

As an example of how the embodiments can operate within already existing vector quantization schemes, one embodiment is described below in the context of an SMSVQ scheme. As noted previously, in an SMSVQ scheme, the input vector is split into subvectors. Each subvector is then processed through a multi-stage structure. The dimension of each input subvector for each stage can remain the same, or can be split even further into smaller subvectors.

Suppose an LPC vector of order 16 is assigned a bit-budget of 32 bits for quantization purposes. Suppose the input vector is split into three subvectors: $X_1$, $X_2$, and $X_3$. For the direct SMSVQ scheme, the coefficient alignment and codebook sizes could be as follows:

TABLE 2

| Direct SMSVQ scheme | | | | |
|---|---|---|---|---|
| | $X_1$ | $X_2$ | $X_3$ | Total Bits |
| # of coefficients | 6 | 6 | 4 | |
| Stage 1 codebook bits | 6 | 6 | 6 | 18 |
| Stage 2 codebook bits | 5 | 5 | 4 | 14 |

As shown, there is a codebook of size $2^6$ codevectors that are reserved for the quantization of subvector $X_1$ at the first stage, and a codebook of size $2^5$ codevectors that are reserved for the quantization of subvector $X_1$ at the second stage. Similarly, the other subvectors are assigned codebook bits. All 32 bits are used to represent the LPC coefficients of a wideband signal.

If an embodiment is implemented to reduce the bit-rate, then the analysis regions of the spectrum are examined for characteristics such as frequency die-offs, so that the frequency die-off regions can be deleted from the quantization. Suppose subvector $X_3$ coincides with a frequency die-off region. Then the coefficient alignment and codebook sizes could be as follows:

TABLE 3

| Bit-rate reduction scheme | | | | |
|---|---|---|---|---|
| | $X_1$ | $X_2$ | $X_3$ | Total Bits |
| # of coefficients | 6 | 6 | N/A | |
| Stage 1 codebook bits | 6 | 6 | N/A | 12 |
| Stage 2 codebook bits | 5 | 5 | N/A | 10 |

As shown, the 32-bit quantization bit-budget can be reduced down to 22 bits without loss of perceptual quality.

If an embodiment is implemented to improve the acoustic properties of certain analysis regions, then coefficient alignment and codebook sizes could be as follows:

TABLE 4

| Quality improvement scheme | | | | | | |
|---|---|---|---|---|---|---|
| | $X_{1(1)}$ | $X_{1(2)}$ | $X_{2(1)}$ | $X_{2(2)}$ | $X_3$ | Total Bits |
| # of coefficients | 6 | | 6 | | N/A | |
| Stage 1 codebook bits | 6 | | 6 | | N/A | 12 |
| Stage 2 coefficient split | 3 | 3 | 3 | 3 | N/A | |
| Stage 2 codebook bits | 5 | 5 | 5 | 5 | N/A | 20 |

The above table shows a split of the subvector $X_1$ into two subvectors, $X_{11}$ and $X_{12}$, and a split of subvector $X_2$ into two subvectors, $X_{21}$ and $X_{22}$, at the beginning of the second stage. Each split subvector $X_{ij}$ comprises 3 coefficients, and the codebook for each split subvector $X_{ij}$ comprises $2^5$ codevectors. Each of the codebooks for the second stage attains their size through the re-allocation of the codebook bits from the $X_3$ codebooks.

It should be noted that the above embodiments are for receiving a fixed length vector and for producing a variable-length, quantized representation of the fixed length vector. The new bandwidth-adaptive scheme selectively exploits information that is conveyed in the wideband signal to either reduce the transmission bit rate or to improve the quality of the more perceptually significant portions of the signal. The above-described embodiments achieve these goals by reducing the dimensionality of subvectors in the quantization domain while still preserving the dimensionality of the input vector for subsequent processing.

In contrast, some vocoders achieve bit-reduction goals by changing the order of the input vector. However, it should be noted that if the number of filter coefficients in successive frames varies, direct prediction is impossible. For example, if there are less frequent updates of the LPC coefficients, conventional vocoders typically interpolate the spectral parameters using past and current parameters. Interpolation (or expansion) between coefficient values must be implemented to attain the same LPC filter order between frames, else the transitions between the frames are not smooth. The same order-translation process must be performed for the LPC vectors in order to perform the predictive quantization or LPC parameter interpolation. See "SPEECH CODING WITH VARIABLE MODEL ORDER LINEAR PREDICTION", U.S. Pat. No. 6,202,045. The present embodiments are for reducing bit-rates or improving perceptually significant portions of the signal without the added complexity of expanding or contracting the input vector in the LPC coefficient domain.

The above embodiments have been described in the context of a variable rate vocoder. However, it should be understood that the principles of the above embodiments could be applied to fixed rate vocoders or other types of coders without affecting the scope of the embodiments. For example, the SPVQ scheme, the MSVQ scheme, the PMSVQ scheme, or some alternative form of these vector quantization schemes can be implemented in a fixed rate vocoder that does not use classification of speech signals through a Frame Classification Unit. For a variable rate vocoder configured in accordance with the above embodiments, the classification of signal types is for the selection of the vocoder rate and is for defining the boundaries of the spectral regions, i.e., frequency bands. However, other tools can be used to determine the boundaries of frequency bands in a fixed rate vocoder. For example, spectral analysis in a fixed rate vocoder can be performed for separately designated frequency bands in order to determine whether portions of the signal can be intentionally "lost." The bit-budgets for these "lost" portions can then be reallocated to the bit-budgets of the perceptually significant portions of the signal, as described above.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in a computer-readable medium, such as RAM memory, flash memory, ROM memory, EPROM memory, EEPROM memory, registers, hard disk, a removable disk, a CD-ROM, or any other form of non-transitory storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for processing an acoustic signal, said method comprising performing each of the following acts within a device that is configured to process acoustic signals:

calculating an energy of a first frame of the acoustic signal in each of a first frequency band and a second frequency band that is higher than the first frequency band;

calculating an energy of a second frame of the acoustic signal in each of the first and second frequency bands;

based on the calculated energies of said first frame in said first and second frequency bands, classifying the first frame as speech, including selecting a first coding rate for said first frame as an initial rate decision for said first frame;

based on the calculated energies of said second frame in said first and second frequency bands, classifying the second frame as speech, including selecting a second coding rate for said second frame as an initial rate decision for said second frame;

calculating an energy of said first frame in a third frequency band that is higher than said second frequency band;

calculating an energy of said second frame in a fourth frequency band that includes at least the first frequency band;

based on the calculated energy of said first frame in said third frequency band, deciding to alter the initial rate decision for said first frame;

based on the calculated energy of said second frame in said fourth frequency band, deciding to alter the initial rate decision for said second frame;

in response to said deciding to alter the initial rate decision for said first frame, selecting a third coding rate for said first frame that is different than said first coding rate; and in response to said deciding to alter the initial rate decision for said second frame, selecting a fourth coding rate for said second frame that is different than said second coding rate, wherein said deciding to alter the initial rate decision for said second frame is not based on a calculated energy of said second frame in said third frequency band.

2. The method according to claim 1, wherein said classifying said first frame is based on information from a set of filter coefficients for said first frame.

3. The method according to claim 1, wherein said classifying said first frame is based on a periodicity of said first frame.

4. The method according to claim 1, wherein said fourth frequency band is separate from said third frequency band.

5. The method according to claim 1, wherein said selecting a third coding rate is based on the number of sign changes in said first frame.

6. The method according to claim 1, wherein said first coding rate allocates a first frame size to carry said first frame, and wherein said third coding rate allocates a second frame size smaller than said first frame size to carry said first frame.

7. The method according to claim 1, wherein said first coding rate allocates m bits to a vector of filter coefficients of said first frame, and wherein said third coding rate allocates fewer than m bits to said vector of filter coefficients.

8. The method according to claim 1, wherein said method comprises encoding said first frame at the third coding rate and encoding said second frame at the fourth coding rate.

9. The method according to claim 1, wherein said method comprises calculating an entire energy of said first frame, and wherein said selecting a third coding rate for said first frame is based on said calculated entire energy of said first frame.

10. The method according to claim 1, wherein said first third frequency band includes frequencies above five kilohertz.

11. The method according to claim 1, wherein said initial rate decision for said first frame is based on energy of at least a portion of a frame of the acoustic signal subsequent to said first frame.

12. The method according to claim 1, wherein said classifying the first frame includes classifying the first frame as voiced speech.

13. The method according to claim 1, wherein said initial rate decision for said first frame is based on a mode of a frame of the acoustic signal previous to said first frame.

14. The method according to claim 1, wherein said third coding rate is less than said first coding rate.

15. The method according to claim 1, wherein said classifying said first frame is based on the energy of a frame of the acoustic signal subsequent to said first frame.

16. An apparatus for processing an acoustic signal, said apparatus comprising:

a frame classifier configured to calculate an energy of a first frame of the acoustic signal in each of a first frequency band and a second frequency band that is higher than the first frequency band and to calculate an energy of a second frame of the acoustic signal in each of the first and second frequency bands;

a voice activity detector configured to determine a presence of speech in a first frame of the acoustic signal and to determine a presence of speech in a second frame of the acoustic signal that is separate from said first frame;

a rate selector configured to produce an initial rate decision for said first frame, based on the determined presence of speech in said first frame, and to produce an initial rate decision for said second frame, based on the determined presence of speech in said second frame; and a spectral analyzer configured to calculate an energy of said first frame in a third frequency band that is higher than said second frequency band and to calculate an energy of said second frame in a fourth frequency band that includes at least the first frequency band, wherein said rate selector is configured to decide to alter the initial rate decision for said first frame, based on the calculated energy of said first frame in said third frequency band, and to decide to alter the initial rate decision for said second frame, based on the calculated energy of said second frame in said fourth frequency band, and wherein said rate selector is configured to produce the initial rate decision for said first frame by selecting a first coding rate for said first frame and to produce the initial rate decision for said second frame by selecting a second coding rate for said first frame, and wherein said rate selector is configured to alter the initial rate decision for said first frame by selecting, in response to said deciding to alter the initial rate decision for said first frame, a third coding rate for said first frame that is different than said first coding rate and to alter the initial rate decision for said second frame by selecting, in response to said deciding to alter the initial rate decision for said second frame, a fourth coding rate for said second frame that is different than said second coding rate, wherein said deciding to alter the initial rate decision for said second frame is not based on a calculated energy of said second frame in said third frequency band.

17. The apparatus according to claim 16, wherein said frame classifier is configured to produce a classification for said first frame, based on the determined presence of speech in said first frame and on information from a set of filter coefficients for said first frame, and wherein said rate selector is configured to produce said initial rate decision for said first frame based on said classification.

18. The apparatus according to claim 16, wherein said frame classifier is configured to produce a classification for said first frame, based on the determined presence of speech in said first frame and on a periodicity of said first frame, and wherein said rate selector is configured to produce said initial rate decision for said first frame based on said classification.

19. The apparatus according to claim 16, wherein said fourth frequency band is separate from said third frequency band.

20. The apparatus according to claim 16, wherein said rate selector is configured to select the third coding rate based on the number of sign changes in said first frame.

21. The apparatus according to claim 16, wherein said spectral analyzer is configured to calculate an energy of said first frame in said fourth frequency band, and wherein said rate selector is configured to select the third coding rate based on the calculated energy of said first frame in said fourth frequency band.

22. The apparatus according to claim 16, wherein said first coding rate allocates m bits to a vector of filter coefficients of said first frame, and wherein said second coding rate allocates fewer than m bits to said vector of filter coefficients.

23. The apparatus according to claim 16, wherein said apparatus is configured to encode said first frame at the third coding rate and to encode said second frame at the fourth coding rate.

24. The apparatus according to claim 16, wherein said spectral analyzer is configured to calculate an entire energy of said first frame, and wherein said rate selector is configured to select the third coding rate for said first frame based on said calculated entire energy of said first frame.

25. An apparatus for processing an acoustic signal, said apparatus comprising:

means for calculating an energy of a first frame of the acoustic signal in each of a first frequency band and a second frequency band that is higher than the first frequency band;

means for calculating an energy of a second frame of the acoustic signal in each of the first and second frequency bands;

means for classifying the first frame as speech, based on the calculated energies of said first frame in said first and second frequency bands, said means including means for selecting a first coding rate for said first frame as an initial rate decision for said first frame;

means for classifying the second frame as speech, based on the calculated energies of said second frame in said first and second frequency bands, said means including means for selecting a second coding rate for said second frame as an initial rate decision for said second frame;

means for calculating an energy of said first frame in a third frequency band that is higher than said second frequency band;

means for calculating an energy of said second frame in a fourth frequency band that includes at least the first frequency band;

means for deciding to alter the initial rate decision for said first frame, based on the calculated energy of said first frame in said third frequency band;

means for deciding to alter the initial rate decision for said second frame, based on the calculated energy of said second frame in said fourth frequency band;

means for selecting, in response to said deciding to alter the initial rate decision for said first frame, a third coding rate for said first frame that is different than said first coding rate; and means for selecting, in response to said deciding to alter the initial rate decision for said second frame, a fourth coding rate for said second frame that is different than said second coding rate, wherein said deciding to alter the initial rate decision for said second frame is not based on a calculated energy of said second frame in said third frequency band.

26. The apparatus according to claim 25, wherein said means for classifying includes a speech classifier.

27. A computer-readable non-transitory storage medium comprising instructions which when executed by a processor cause the processor to:

calculate an energy of a first frame of the acoustic signal in each of a first frequency band and a second frequency band that is higher than the first frequency band;

calculate an energy of a second frame of the acoustic signal in each of the first and second frequency bands;

classify the first frame as speech, based on the calculated energies of said first frame in said first and second frequency bands, including selecting a first coding rate for said first frame as an initial rate decision for said first frame;

classify the second frame as speech, based on the calculated energies of said second frame in said first and second frequency bands, including selecting a second coding rate for said second frame as an initial rate decision for said second frame;

calculate an energy of said first frame in a third frequency band that is higher than said second frequency band;

calculate an energy of said second frame in a fourth frequency band that includes at least the first frequency band;

decide to alter the initial rate decision for said first frame, based on the calculated energy of said first frame in said third frequency band;

decide to alter the initial rate decision for said second frame, based on the calculated energy of said second frame in said fourth frequency band;

in response to said deciding to alter the initial rate decision for said first frame, select a third coding rate for said first frame that is different than said first coding rate; and in response to said deciding to alter the initial rate decision for said second frame, select a fourth coding rate for said second frame that is different than said second coding rate, wherein said deciding to alter the initial rate decision for said second frame is not based on a calculated energy of said second frame in said third frequency band.

* * * * *